US005123369A

United States Patent [19]

Gross

[11] Patent Number: 5,123,369

[45] Date of Patent: Jun. 23, 1992

[54] MARINE VALVE STRUCTURE

[76] Inventor: Donald P. Gross, 6113 Northdale Rd., Catonsville, Md. 21228

[21] Appl. No.: 585,195

[22] Filed: Sep. 20, 1990

[51] Int. Cl.[5] ..... B63B 13/00

[52] U.S. Cl. ..... 114/183 R; 138/89; 137/625.41; 251/100; 440/88

[58] Field of Search ..... 114/183 R, 197, 198; 440/88; 138/89, 92, 94; 137/625.41, 315, 320, 323; 251/100, 297; 220/307, 315, 324

[56] References Cited

U.S. PATENT DOCUMENTS

| | | | |
|---|---|---|---|
| 361,931 | 4/1887 | Daimler | 114/197 |
| 2,350,598 | 6/1944 | Faville | 440/88 X |
| 3,550,612 | 12/1970 | Maxon | 137/112 |
| 3,679,170 | 7/1972 | Bernas et al. | 251/297 X |
| 3,739,589 | 6/1973 | Wolfe | 220/324 X |
| 3,744,313 | 7/1973 | Thompson | 137/315 X |
| 3,946,694 | 3/1976 | Belsky | 114/183 |
| 4,177,832 | 12/1979 | Price | 251/315 X |
| 4,619,618 | 10/1986 | Patti | 440/88 |
| 4,693,690 | 9/1987 | Henderson | 440/88 |
| 4,789,367 | 12/1988 | Fulks | 440/88 |

*Primary Examiner*—Edwin L. Swinehart
*Attorney, Agent, or Firm*—Walter C. Farley

[57] ABSTRACT

A valve apparatus for a marine vessel has a housing with first, second, and third ports and a valve member within the housing. The housing is mounted to the hull of the vessel with the first port communicating with the body of water outside of the vessel. The third port is connected to the cooling system of an engine in the vessel and the second port is closed by a quick-release plug. The valve member is movable to open and close communication with the outside. During normal operation, water is drawn through the structure into the engine cooling system and is discharged overboard. In an emergency, the plug can be removed and the valve member moved to a 90° position in which communication with the outside is closed, allowing the engine to draw water from within the hull and discharge it overboard. The structure can also be used with a service adapter for engine flushing and other maintenance.

13 Claims, 3 Drawing Sheets

MARINE VALVE STRUCTURE

This invention relates to an improved marine valve structure of a type which performs the function of a conventional seacock and also facilitates the control of fluid flow for other purposes.

BACKGROUND OF THE INVENTION

A seacock is a type of valve used to control the intake or discharge of water through the hull of a marine craft. A seacock is typically operated by manually moving a handle between two positions to move a valve 90° to open or close a conduit which extends through the hull. In many marine vessels, a propulsion engine for the vessel is cooled by water drawn in through the seacock in its open position by a self-priming pump which delivers the water to the internal cooling system of the engine. The water is drawn in from the body of water in which the vessel floats and is pumped back overboard through the engine's exhaust system. Typically, the seacock or seacocks controlling the flow of water to one or more engines in the vessel performed only the function of either permitting or preventing flow of water to the engine cooling system.

It is also customary to provide a vessel with one or more bilge pumps which, depending upon the size and sophistication of the vessel, are operated manually, electrically or mechanically from the engine for the purpose of periodically pumping out water which occasionally accumulates in the bilge. Bilge pumps are generally intended to pump out water which is present because of the gradual accumulation of water from ordinary minor leakage through or around various hull fittings throughout the craft or resulting from rough sea conditions. Such pumps are not generally capable of coping with a large inflow of water from an unexpected source such as an opening created by hull damage sustained from striking a submerge object or another craft.

In the event of such an emergency, the rapid and unexpected inflow of water could jeopardize the safety of the craft and those on board and could eventually sink the craft if immediate corrective action is not taken.

For this reason, various proposals have been made to use the engine cooling system as an additional pump so that, in the event of serious emergency conditions, the cooling system pump can extract water from the interior of the vessel rather than from the body of water surrounding the vessel, operating in conjunction with the bilge pumps to keep the vessel afloat until repairs or other steps appropriate to the circumstances can be taken.

However, structures for this purpose proposed in the past have had various disadvantages due to the arrangement of the system or for other reasons and have gained substantially no acceptance in the marine industry.

BRIEF SUMMARY OF THE INVENTION

Accordingly, an object of the present invention is to provide an improved valve structure performing the conventional functions of a seacock and also facilitating the use of an engine cooling system pump to aid in removing water from within the vessel in emergency circumstances.

A further object is to provide such a valve which further facilitates drainage of the engine cooling system, flushing of the cooling system and the addition of winterizing fluids thereto.

Yet another object is to provide such a valve structure in which the operating handle is provided with means to inhibit inadvertent movement from one position to the other.

Briefly described, the invention includes an improved valve apparatus for a marine vessel of the type having a hull and an engine with a cooling system normally cooled by water drawn from the body of water in which the vessel travels and discharged overboard, the valve apparatus including a housing having first, second and third ports and an interior passageway interconnecting those ports. The housing is mounted near the bottom of the hull with the first port in communication with the body of water in which the vessel floats. A conduit interconnects the third port with the engine cooling system. Within the housing, a valve member is movably mounted and has a canal therethrough. A handle is coupled to the valve member for manually moving the member between a first position in which the canal interconnects the first and third ports to allow flow from the body of water to the cooling system and a second position in which the valve member blocks the first port. A plug is manually insertable into and removable from the second port such that the plug can be inserted into the second port to block flow through that port with the valve member in the first position for normal operation and the plug can be removed from the second port and the valve member moved to the second position when the second port is under water accumulated in the hull so that the engine can draw water from within the hull and discharge it overboard in an emergency situation.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this disclosure and wherein.

DESCRIPTION OF THE PREFERRED EMBODIMENTS

Figure 1:
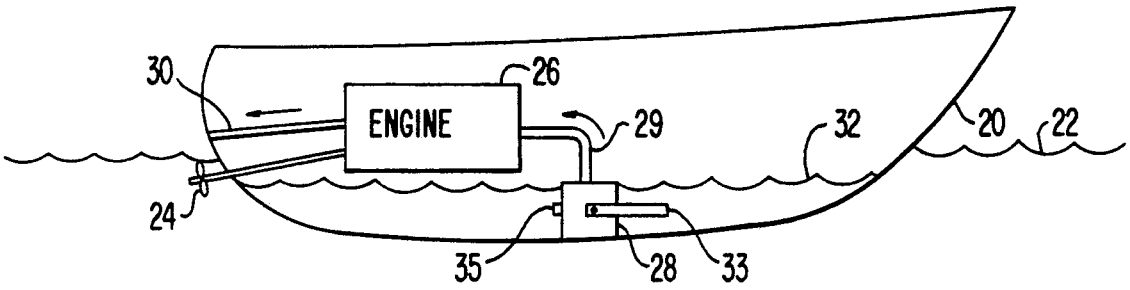
FIG. 1 is a simplified schematic diagram of the hull of a vessel, diagrammatically showing an engine and a valve structure in accordance with the present invention.

FIG. 1 shows, in very simplified form, the context of the apparatus of the present invention. As shown therein, the hull 20 of a marine vessel is designed to float in a body of water 22 and to be propelled by a propeller 24 driven by an engine 26. The engine has a cooling system which requires the flow of cooling water which is drawn into the engine through a valve 28 and a conduit or hose 29 into the engine, the used cooling water then being discharged overboard by a pipe 30. Valve 28 is preferably mounted near the bottom of the hull, i.e., as close to the keel as is practical. Normally, the cooling water is drawn from the exterior of the vessel but, under emergency circumstances when there is an excess accumulation of water 32 within the vessel, the valve can be changed to a different position by moving a handle 33 so that water is drawn through the valve from an inlet 35 which is below the surface of the accumulated water 32. This accumulation is passed through the engine to perform the cooling function and is discharged overboard, assisting the function of the conventional bilge pumps, not illustrated, which are normally provided in such a vessel.

A particularly advantageous form of the valve structure in accordance with the invention is shown in FIGS. 2–8. Referring first to FIGS. 2, 3, 7, and 8, it will be seen that the valve structure includes a housing 36 having a base flange 38 and a first internally threaded port 40 which extends through the flange into an interior passage through the housing. The housing is attached to the hull 20 of the vessel in alignment with an opening 41 formed in the vessel and is attached in a conventional fashion by a flange 43 which abuts the outer surface of hull 20 and has an externally threaded pipe 44 formed thereon. When the external threads of pipe 44 engage the internal threads of port 40, hull 20 is clamped between flange 43 and flange 38, securely holding housing 36 to the inner surface of the hull.

A tube 46 is formed at one side of housing 36 and surrounds an opening 48 which defines a second port into the housing, tube 46 being dimensioned to receive a plug 50. Plug 50 is formed with an annular recess 67 and has an end seal or gasket 51 of soft rubber or the like to form a watertight seal with the surface around opening 48. At the top of housing 36 is a third port including an opening 52 and an internally threaded tubular portion 53. Portion 53 is formed as a separate piece from the remainder of housing 36 and has external threads 54 which are received in internal threads 56 on the housing. When assembled, the two components are sealed by an O-ring 57 and gasket 62 and function as one piece.

Figure 5:
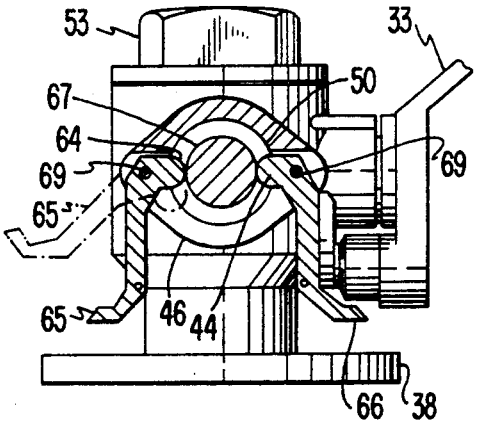
FIG. 5 is a side elevation, in partial section, along line 5—5 of FIG. 2.

Within housing 36 is a cavity which receives valve member 60 which comprises a spherical valve member having a T-shaped canal therethrough. Within the cavity, the valve member is seated in gaskets 62. As seen in FIGS. 2–5, tube 46 is formed with openings 63 in the sides thereof, which openings receive dogs 64 at the ends of locking levers 65 and 66. Plug 50 is formed with an annular recess 67. As seen in FIGS. 4 and 5, levers 65 and 66 are pivotally mounted on pivot pins 69. In the positions shown in FIGS. 3 and 5, the dogs 64 at the inner ends of levers 65 and 66 lie in recess 67. However, the levers can be pivoted outwardly, as shown in broken lines in FIG. 5, so that the dogs are removed from annular recess 67, allowing the stopper to be manually extracted using pull ring 70. This locking arrangement prevents plug 50 from being removed inadvertently or as the result of vibration.

Figure 2:
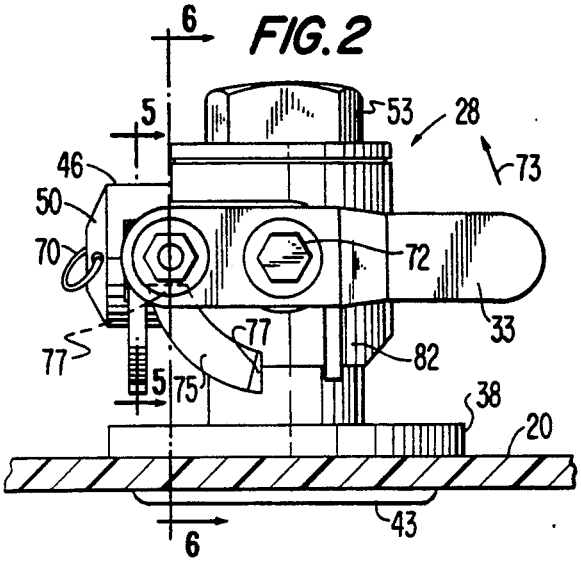
FIGS. 2 and 3 are front and side elevations, respectively, of a valve structure in accordance with the present invention with the valve handle being shown in the closed and open positions, respectively.
Figure 7:
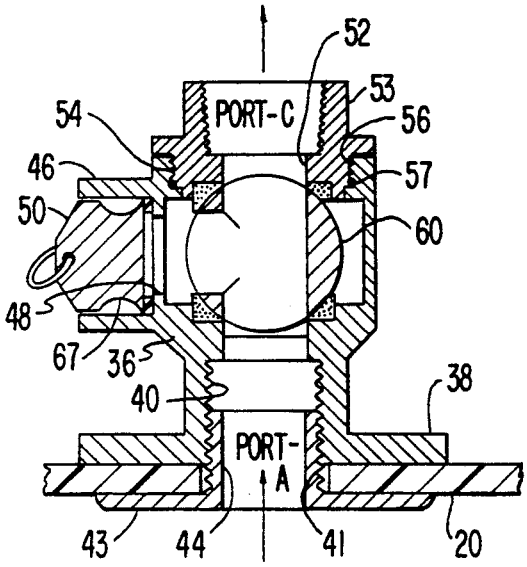
FIGS. 7 and 8 are front elevations, in section, along line 7—7 of FIG. 3 showing, respectively, the valve member in the open and closed positions.
Figure 8:
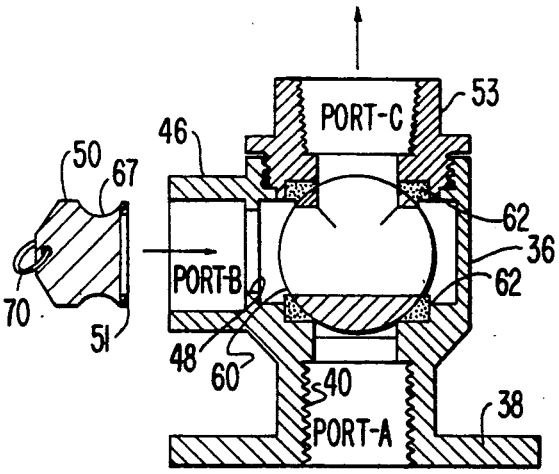

Handle 33 is connected to valve member 60 by a bolt 72 so that when the handle is rotated 90° from the position shown in FIG. 2, the valve ball is rotated from the position shown in FIG. 8 to the position shown in FIG. 7. This movement is in the direction of arrow 73 (FIG. 2). In the position of FIG. 7, which will be referred to as the open position, fluid flow is permitted through the valve structure from port A to port C as indicated by the arrows. Flow would also be possible through port B, but is prevented by the presence of plug 50. Thus, under normal operating conditions, the valve handle is in the position shown in FIG. 3, the valve member is in the position shown in FIG. 7 and cooling water enters from outside of the hull through the valve structure and out of port C. Member 53 is provided with conventional NPT tapered threads to receive a fitting for a conduit leading to the engine having a cooling water pump associated therewith.

Under emergency conditions, when the engine cooling system is to be used to assist the bilge pumps, locking levers 65 and 66 are moved to their outermost positions, plug 50 is extracted, and lever 33 is moved to the position shown in FIG. 2, moving the valve member to the position shown in FIG. 8 which closes port A and permits water to enter Port B. No tools are required for this change since the locking levers can be manually snapped outwardly without difficulty. The change can be accomplished quickly and the engine can then be employed to assist with the removal of accumulated water from within the hull. It is particularly important that one need not seek a special tool of any kind to accomplish this change and that it can be done quickly and easily without stopping the engine.

Figure 6:
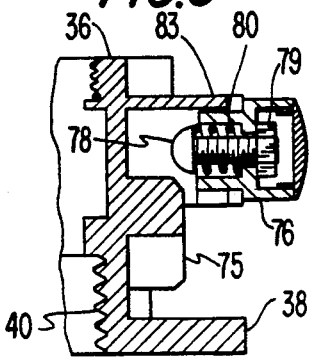
FIG. 6 is a partial side elevation along line 6—6 of FIG. 2.
Figure 3:
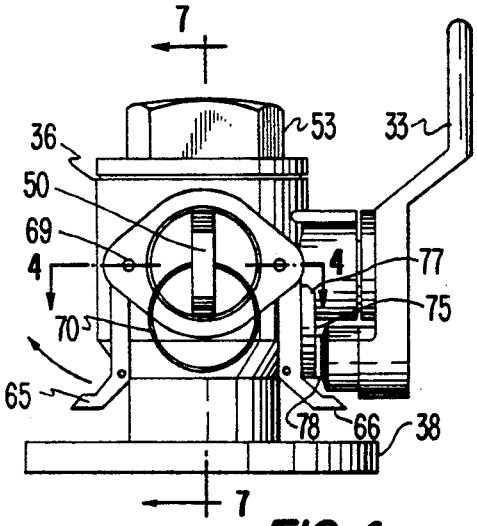
Figure 4:
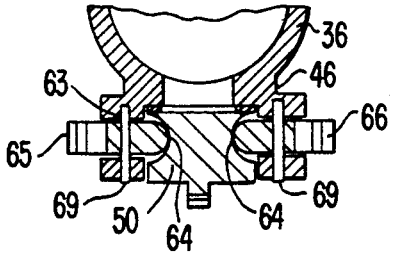
FIG. 4 is a partial sectional view along line 4—4 of FIG. 3.

In order to prevent the inadvertent movement of handle 33 from one position to the other, housing 36 is provided with an arcuate surface 75 which is formed on the outside of the housing as seen in FIGS. 2, 3, and 6. Bevelled end surfaces 77 are formed at opposite ends of the arcuate surface. At the end of handle 33 is a cam follower 78 which is held in a sleeve 76 in the handle by a lock nut 79 and urged toward surfaces 75 and 77 by a compression coil spring 80. Referring particularly to FIG. 6, when the handle is moved toward the open position from that shown in FIG. 2, the rounded end of cam follower 78 rides up surface 77, slightly compressing spring 80 and moves downwardly across arcuate surface 77 until the follower again leaves the surface at the other bevel. A mechanical stop 82 limits the motion in one direction and a second stop 83 limits movement in the other direction. Spring 80 is chosen to have sufficient force to require some effort to move the handle from either the open or closed position.

Figure 9:
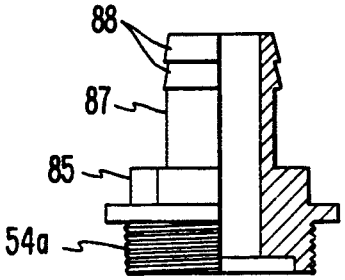
FIGS. 9 and 10 are side elevations, in partial sections, of alternative fittings usable in the valve structure of FIGS. 2–8.
Figure 10:
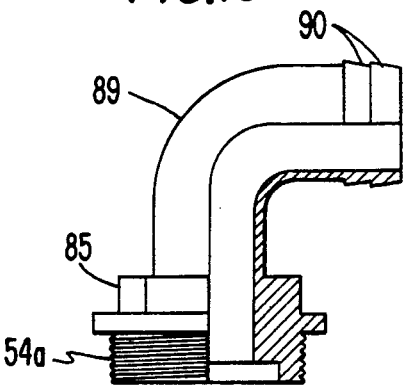

Member 53, the exterior of which is formed hexagonally so as to be engageable by a conventional wrench, can be replaced by either of the fittings shown in FIGS. 9 and 10. Each of these fittings includes threads 54A which are the same as threads 54 and a hexagonal outer surface 85 which is the same as the outer hexagonal surface of member 53. The fitting of FIG. 9 includes a straight tubular portion 87 with tapered end surfaces 88 which will be recognized as the conventional surfaces to receive a hose. Similarly, FIG. 9 has a 90° curved portion 89 and tapered surfaces 90 to accept a hose. Thus, if the particular installation for the valve structure is to be used with a hose rather than tapered thread fitting, member 53 is replaced by whichever one of the fittings of FIGS. 9 and 10 is most suitable for the circumstances.

Figure 11:
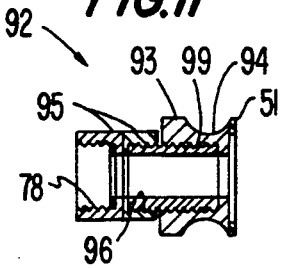
FIG. 11 is a side elevation, in section, of a fitting usable in place of the plug illustrated in FIGS. 7 and 8.

In addition to the emergency use discussed above, the valve structure of the present invention is advantageously used during routine maintenance of the engine. It is frequently desirable to flush the cooling system with fresh water or to introduce into the cooling system a solution of antifreeze for winterization. For this purpose, a service adapter indicated generally at 92 (FIG. 11) is provided. The service adapter has an end seal 51, the same as plug 50, and has a main body 93 with a recess 94 substantially the same as plug 50. A swivel adapter 95 is threaded at one end for ¾ in. MPT female threads 96 and at the other end with internal threads 98 to receive a garden hose. A short pipe nipple 99 connects the swivel adapter to plug replacement member 93.

To use this component, plug 50 is removed and the service adapter is inserted in tubular member 46. With the locking handles in their locked position, a hose can be attached to threads 98 and fresh water can be introduced into the engine with the valve member in the position shown in FIG. 8. The engine is left off during this operation, the flushing being accomplished by the pressure from the water source feeding the garden hose.

For winterization, the antifreeze solution can be introduced in the same fashion.

Also as part of a winterization procedure, the engine cooling system can easily be drained through port B by simply removing plug 50. This opening is considerably larger than the drain openings normally provided in an engine cooling system and can be used either alone or in conjunction with the other engine drain openings to rapidly remove water from the cooling system. If the vessel is removed from the water as in dry dock or the like, drainage can be accomplished through port A or port B.

Figure 12:
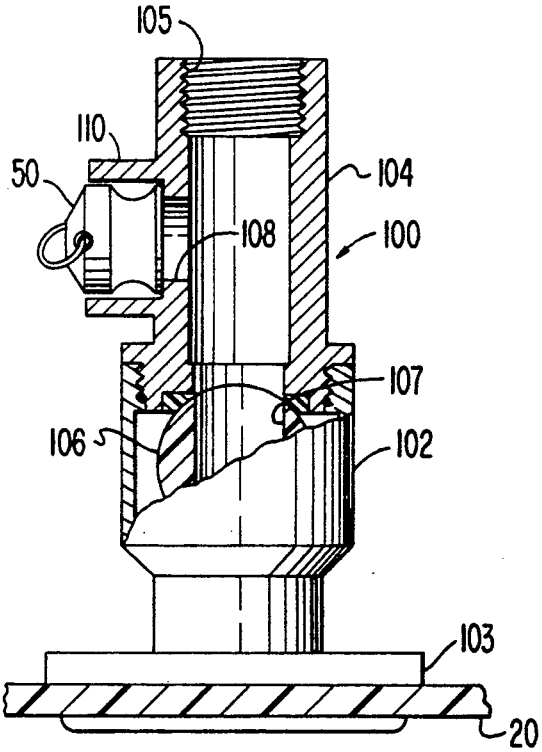
FIG. 12 is a front elevation, in partial section, of a further embodiment of a valve in accordance with the present invention.

An alternative embodiment of a valve structure in accordance with the invention is shown in FIG. 12. As seen therein, a housing indicated generally at 100 includes a lower valve housing 102 which has a flange 103 connected to the hull 20 of the vessel in the manner previously described and an upper portion 104, the upper end of which is internally threaded at 105 the same as member 53 shown in FIGS. 7 and 8. Alternatively, the upper end of portion 104 can be shaped to form a straight or 90° hose fitting as in the devices shown in FIGS. 9 and 10. Valve housing 102 is provided with a handle, not shown, but substantially identical to that shown in FIGS. 2, 3, 5, and 6. A valve ball 106 is provided with a single through-passage 107 rather than a T-canal and is retained in the valve housing in the manner illustrated and discussed in connection with FIGS. 7 and 8.

Upper portion 104 has a lateral opening 108 surrounded by a tube 110 closed by quick-release plug 50. Locking handles, substantially the same as handles 65 and 66, can also be provided to retain plug 50 in position. The operation of the device shown in FIG. 12 is very similar to the previously discussed embodiment. During normal operation, the valve member 106 is in the position shown which permits flow of water from outside the vessel through a conduit attached to threads 105 to the engine. When it is necessary to extract water from within the vessel, the valve member is moved 90° to close the port from the outside and plug 50 is removed, allowing extraction of water from within the vessel. A service adapter like that shown in FIG. 11 can be substituted for plug 50 for routine maintenance as discussed above.

The embodiment of FIG. 12 has the advantage of a somewhat simpler valve housing but has the disadvantage of greater spacing between the hull and port B (opening 108) and therefore requires a larger amount of water in the hull before the valve structure can be used in conjunction with the engine for pumping overboard.

While certain advantageous embodiments have been chosen to illustrate the invention, it will be understood by those skilled in the art that various changes and modifications can be made therein without departing from the scope of the invention as defined in the appended claims.

What is claimed is:

1. An improved valve apparatus for a marine vessel having a hull and an engine having a cooling system cooled by water drawn from the body of water in which the vessel travels and discharged overboard, the valve apparatus comprising the combination of a housing having first, second and third ports and an interior passageway interconnecting said ports;

means for mounting said housing on said hull adjacent the bottom of said hull with said first port in communication with said body of water;

conduit means interconnecting said third port with said engine cooling system;

a valve member movably mounted in said housing, said valve member comprising a body having means defining a canal therethrough;

a handle coupled to said valve member for manually moving said valve member 90° between a first position in which said canal interconnects said first and third ports to allow flow from said body of water to said cooling system and a second position in which said valve member blocks said first port;

a non-threaded plug manually insertable into and removable from said second port, and means for holding said plug in said second port against pressure from within said second port whereby said plug can be inserted into said second port to block flow through said port with said valve member in said first position for normal operation, said means for holding being manually releasable so that said plug can be removed from said second port and said valve member moved to said second position when said second port is under water accumulated in said hull so that said engine can draw water from within said hull and discharge it overboard in an emergency situation.

2. An apparatus according to claim 1 wherein said second port communicates with said passageway between said valve member and said conduit means.

3. An apparatus according to claim 1 wherein said second port enters said housing adjacent said valve member and said valve member includes a canal communicating with said second port in at least said second position.

4. An apparatus according to claim 3 wherein said second port comprises a tubular member protruding from said housing and having openings on opposite sides thereof, said plug comprises a body insertable into said tubular member and having recesses on opposite sides thereof, and said apparatus further comprises first and second locking handles pivotally attached to said tubular member, each said locking handle having formed thereon a latch dog insertable through one of said openings in said tubular member to enter a recess in said plug so that said plug cannot be removed from said tubular member until said locking handles are pivoted outwardly to remove said dogs from said recesses.

5. An apparatus according to claim 4 wherein said housing includes an internally threaded opening and an externally threaded member having said third port formed therein, said externally threaded member being replaceable by a similarly threaded member having a differently shaped third port formed therein.

6. An apparatus according to claim 5 and further comprising means for resisting movement of said handle from the one of said first and second positions which it occupies to thereby prevent inadvertent movement of said valve member.

7. An apparatus according to claim 6 wherein said handle moves between said first and second positions in substantially one plane and wherein said means for resisting movement comprises an arcuate body at one side of said housing having a surface lying in a plane substantially parallel with the plane containing said handle, said arcuate body subtending an angle less than the extent of movement of said handle and having beveled cam portions at both ends of said surface sloping toward said housing;

a cam follower mounted on said handle and movable therewith; and spring means for urging said cam follower toward said arcuate body so that said cam follower rides along said surface between said positions.

8. An apparatus according to claim 3 and further comprising means for resisting movement of said handle from the one of said first and second positions which it occupies to thereby prevent inadvertent movement of said valve member.

9. An apparatus according to claim 8 wherein said handle moves between said first and second positions in substantially one plane and wherein said means for resisting movement comprises an arcuate body at one side of said housing having a surface lying in a plane substantially parallel with the plane containing said handle, said arcuate body subtending an angle less than the extent of movement of said handle and having beveled cam portions at both ends of said surface sloping toward said housing;

a cam follower mounted on said handle and movable therewith; and spring means for urging said cam follower toward said arcuate body so that said cam follower rides along said surface between said positions.

10. An apparatus according to claim 1 wherein said second port comprises a tubular member protruding from said housing and having openings on opposite sides thereof, said plug comprises a body insertable into said tubular member and having recesses on opposite sides thereof, and said apparatus further comprises first and second locking handles pivotally attached to said tubular member, each said locking handle having formed thereon a latch dog insertable through one of said openings in said tubular member to enter a recess in said plug so that said plug cannot be removed from said tubular member until said locking handles are pivoted outwardly to remove said dogs from said recesses.

11. An apparatus according to claim 1 and further comprising means for resisting movement of said handle from the one of said first and second positions which it occupies to thereby prevent inadvertent movement of said valve member.

12. An improved valve apparatus for a marine vessel having a hull and an engine having a cooling system cooled by water drawn from the body of water in which the vessel travels and discharged overboard, the valve apparatus comprising the combination of a housing having first, second and third ports and an interior passageway interconnecting said ports;

means for mounting said housing near the bottom of said hull with said first port in communication with said body of water;

conduit means interconnecting said third port with said engine cooling system;

a valve member movably mounted in said housing, said valve member comprising a body having means defining a canal therethrough;

a handle coupled to said valve member for manually moving in substantially one plane said valve member between a first position in which said canal interconnects said first and third ports to allow flow from said body of water to said cooling system and a second position in which said valve member blocks said first port;

means for resisting movement of said handle from the one of said first and second positions which it occupies to thereby prevent inadvertent movement of said valve member said means for resisting movement comprising an arcuate body at one side of said housing having a surface lying in a plane substantially parallel with the plane containing said handle, said arcuate body subtending an angle less than the extent of movement of said handle and having beveled cam portions at both ends of said surface sloping toward said housing;

a cam follower mounted on said handle and movable therewith; and spring means for urging said cam follower toward said arcuate body so that said cam follower rides along said surface between said positions; and a plug manually insertable into and removable from said second port, whereby said plug can be inserted into said second port to block flow through said port with said valve member in said first position for normal operation and whereby said plug can be removed from said second port and said valve member moved to said second position when said second port is under water accumulated in said hull so that said engine can draw water from within said hull and discharge it overboard in an emergency situation.

13. An improved valve apparatus for a marine vessel having a hull and an engine having a cooling system cooled by water drawn from the body of water in which the vessel travels and discharged overboard, the valve apparatus comprising the combination of a valve housing having first, second and third ports and an interior passageway interconnecting said ports;

means for mounting said valve housing on said hull near the bottom of said hull with said first port in communication with said body of water;

conduit means interconnecting said third port with said engine cooling system;

a valve member movably mounted in said housing, said valve member comprising a body having means defining a canal therethrough and three openings to said canal;

a handle coupled to said valve member for manually moving said valve member between a first position in which said passageway interconnects said first and third ports and a second position in which said passageway interconnects said second and third ports and blocks said first port, said first and second positions being separated by about 90°;

a non-threaded plug manually insertable into and removable from said second port without the use of a tool, and means for holding said plug in said second port, whereby said plug can be inserted into said second port to block flow through said port with said valve member in said first position for normal operation, said means for holding being manually releasable without the use of a tool so that said plug can be removed from said second port and said valve member moved to said second position when said second port is under water accumulated in said hull so that said engine can draw water from within said hull in an emergency situation.

* * * * *